US009021753B2

(12) United States Patent
Michaud

(10) Patent No.: US 9,021,753 B2
(45) Date of Patent: May 5, 2015

(54) TRANSITION ASSEMBLIES FOR BUILDING OPENING

(76) Inventor: Donald A. Michaud, Marblehead, MA (US)

( * ) Notice: Subject to any disclaimer, the term of this patent is extended or adjusted under 35 U.S.C. 154(b) by 219 days.

(21) Appl. No.: 13/573,421

(22) Filed: Sep. 15, 2012

(65) Prior Publication Data

US 2013/0008106 A1 Jan. 10, 2013

Related U.S. Application Data

(60) Continuation-in-part of application No. 12/924,062, filed on Sep. 20, 2010, now Pat. No. 8,272,117, which is a division of application No. 11/800,261, filed on May 4, 2007, now Pat. No. 7,797,891.

(51) Int. Cl.

| | |
|---|---|
| ***E06B 3/277*** | (2006.01) |
| ***E06B 1/68*** | (2006.01) |
| *E06B 7/22* | (2006.01) |
| *E06B 1/60* | (2006.01) |
| *E06B 1/62* | (2006.01) |

(52) U.S. Cl.

CPC ..... *E06B 1/68* (2013.01); *E06B 1/6069* (2013.01); *E06B 2001/628* (2013.01); *Y10S 277/924* (2013.01)

(58) Field of Classification Search

CPC ..... F16J 15/061; F16J 15/062; F16J 15/025; F16J 15/104; F24C 15/021; E06B 7/23; E06B 7/2305; E06B 7/2307; E06B 7/231; E06B 2001/622; E06B 2001/628; E06B 2001/62; E06B 2001/6069; E06B 2001/68

USPC ..... 52/211, 717.01, 741.4; 277/921, 628, 277/637, 640, 641, 642, 644

See application file for complete search history.

(56) References Cited

U.S. PATENT DOCUMENTS 6,557,309 B1 * 5/2003 Johnson ..... 52/210

* cited by examiner

*Primary Examiner* — David Bryant
*Assistant Examiner* — Jason L Vaughan
(74) *Attorney, Agent, or Firm* — Don Halgren

(57) ABSTRACT

A sealing assembly for securely and insulatively maintaining a window or door and surrounding frame arrangement within an opening of a building wall. The sealing assembly comprises an elongated foam cell body member arranged within a channel of the surrounding frame arrangement of the window or door, wherein the elongated cell body member has a wall-opening-facing side. An elongated caulking band flange member is arranged in abutting relationship with a corner of the elongated foam cell body member. A thin flexible air fin is arranged in close environmental sealing relationship with the elongated foam cell body member and the opening in the wall of the building. A securement member is arranged to fasten the window or door surrounding frame arrangement, the elongated foam cell body member and the air fin, all to the building wall opening.

7 Claims, 11 Drawing Sheets

TRANSITION ASSEMBLIES FOR BUILDING OPENING

BACKGROUND OF THE INVENTION

1. Field of the Invention

This invention relates to building construction, and more particularly to apparatus and methods for sealing openings around window and door members by the adaptation of an installation assembly for those windows and doors as best fitted to the buildings receptive conditions, the present application being a continuation-in-part application of application Ser. No. 12/924,062, now U.S. Pat. No. 8,272,117, issued on 25 Sep. 2012, which is a divisional application of U.S. Pat. No. 7,797,891 issued on 21 of Sep. 2010, each of which are incorporated by reference herein, in their entirety.

2. Prior Art Discussion

U.S. Pat. No. 7,797,891 describes an effective method for the installation and sealing of door and window frames to a building opening, so as to comprise a proper air barrier there between. One aspect of that invention is the use of a closed cell polyethylene "foam body" which may be re-shaped through an extruder and then effectively plasticly sealed to a perimeter frame. Such a "foam body" supports an assembly comprised of a co-extruded "air fin", a "compression rod", an inserted "shim post" and "corner termination blocks". Collectively, such assembly transitions the space between the opening in the building and the frame of the door or window to be inserted within. The "air fin" however is co-extruded onto the "foam body" and is comprised of polyethylene, and the options for effectively sealing this material are unfortunately limited to thermoplastic welding. The "terminal block" portion of this assembly is solid and as such, would resist flexing during a seismic event.

It is hence, an object of the present invention, to overcome the disadvantages of the prior art.

It is a further object of the present invention to provide a method of interchanging the components of the assembly, so as to effectively transition the space between the polyethylene "foam body" and the building opening, so as to allow the use of conventional building sealants therewithin.

It is still yet another object of the present invention, to provide air fin corner which will permit flexure during a seismic event.

BRIEF SUMMARY OF THE INVENTION

The present invention relates to a sealing assembly, for sizing and adapting a window frame or a door frame into a building opening with proper insulation and gap sealing arrangements therearound, so as to enable that window frame or door frame to fit snugly within that opening and eliminate environmental penetration either from the outside-in or from the inside-out.

The sealing assembly comprises an extruded, elongated, generally rectilinearly shaped foam body insulating member comprised of closed cell foam of varying densities. The foam body insulating member has a first or inwardly directed enclosure-frame facing side which faces and mates snugly with a channel of a wall-opening facing side of the window/door frame, the frame being that which peripherally surrounds and supports a window sash or door therewithin. The foam body insulating member also has a wall opening facing side with extrusion-effected seal-engaging shapes.

The seal engaging shape in a first embodiment of the present invention comprises a generally elongated (semicircular in cross-section) engaging ridge which is extruded with the length of the foam body insulating member.

The engaging ridge has an elongated truncated receiving channel extending longitudinally therealong. The truncated receiving channel preferably has extruded barb-like teeth extending therewithin. The sealing assembly further includes an elongated flexible air fin. The air fin preferably has an inner layer of soft insulated material extending through its entire length. The air fin has longitudinal edges which preferably have a saw tooth configuration of thereon, so as to be easily insertable and receivable snugly by the receiving channel on the receiving ridge of the elongated foam body member. The elongated foam body member is held within the peripheral receiving frame which surrounds the door or window.

The sealing assembly further includes a sealing or "caulk band" engagement flange which is secured to an outer edge of the elongated foam body member. The engagement flange, preferably made of ABS plastic, vinyl or thermoplastic material, in a first embodiment thereof has a saw tooth edge for engaging and compressing an elongated gasket member against the side wall of the window opening. A second embodiment of the "caulk band" has a receiving channel therein, co-extruded therewith, having internal ridges extending therealong. Those internal ridges are utilized to fully grasp one longitudinal side of the elongated air fin when it is inserted therewithin.

The sealing assembly in one preferred embodiment is established when the receiving frame which holds the window or door therewithin, is secured to the frame of the opening in the building wall. The elongated foam body extrusion is inserted into the channel of the receiving frame so it faces the wall opening. The foam body member extrusion will have its elongated receiving flange there secured. A first elongated edge of the air fin is inserted into the air fin receiving channel of the caulk band flange. An elongated fender of resilient cushion material is inserted between the elongated foam extrusion and the wall opening. A second elongated edge of the air fin is positioned between the elongated fender so as to be captured between the elongated fender and the frame of the opening in the wall of the building. Securement fasteners are inserted through proper openings within the receiving frame, through the foam extrusion and through the elongated fender as well as the air fin which is thus sealingly sandwiched against the frame of the building opening, so as to secure the entire assembly, including the window or door frame, to the internal periphery of the opening within the wall of the building.

The sealing assembly also includes an "L" shaped air fin corner member, of flexible material having a first surface with undulating ridges thereon, and an inner edge with a lip extending therefrom. The lip has a plurality of elongated flexible receiving channel engaging flaps thereon to ensure proper engagement and sealing properties with the receiving channel of an adjacent caulking band with which it mates.

The invention thus comprises a sealing assembly for securely and insulatively maintaining a window or door and surrounding frame arrangement within an opening of a building wall, the sealing assembly comprising, an elongated foam cell body member arranged within a channel of the surrounding frame arrangement of the window or door, wherein the elongated cell body member has a wall-opening-facing side, an elongated caulking band flange member in abutting relationship with a corner of the elongated foam cell body member, a thin flexible air fin arranged in close environmental sealing relationship with the elongated foam cell body member and the opening in the wall of the building, and a securement member for fastening the window or door surrounding frame arrangement, the elongated foam cell body member and the air fin, all to the building wall opening. The elongated foam cell body member preferably has an elongated ridge extending longitudinally therealong. The elongated ridge preferably has an elongated channel extending therealong. The elongated air fin preferably has an elongated first edge which is snugly received in the elongated channel in the elongated ridge. The elongated air fin also has an elongated second edge which is fastened to the building wall opening by the securement member. The elongated caulking band may have an elongated receiving channel extending longitudinally therealong, in close proximity to the elongated foam cell body member. The elongated air fin may have an elongated first edge which is snugly received in the elongated channel in the elongated caulking band. The elongated air fin has an elongated second edge which is fastened to the building wall opening by the securement member. An "L" shaped air fin is preferably inserted into an end portion of peripherally adjacent elongated receiving channels of adjacent caulking bands.

The invention thus may also comprise a method of sealing and securely and insulatively maintaining a window or door and surrounding frame arrangement within an opening of a building wall, the sealing assembly comprising one or more the steps of: placing an elongated foam cell body member arranged within a channel of the surrounding frame arrangement of the window or door, wherein the elongated cell body member has a wall-opening-facing side; securing an elongated caulking band flange member in abutting relationship with a corner of the elongated foam cell body member; mating a thin flexible air fin arranged in close environmental sealing relationship with a receiving channel in the elongated foam cell body member and the opening in the wall of the building; and a securement member for fastening the window or door surrounding frame arrangement, the elongated foam cell body member and the air fin, all to the building wall opening.

The method may include inserting an "L" shaped air fin into receiving channels of an "L" shaped corner configuration of adjacent caulking band members installed around the frame assembly, and attaching a caulk band onto a receiving strip of a foam cell body member, so as to permit a first edge air fin to be secured only to the caulk band.

BRIEF DESCRIPTION OF THE DRAWINGS

The objects and advantages of the present invention will become more apparent, when viewed in conjunction with following drawings, in which.

DETAILED DESCRIPTION OF THE PREFERRED EMBODIMENTS

Figure 1N:
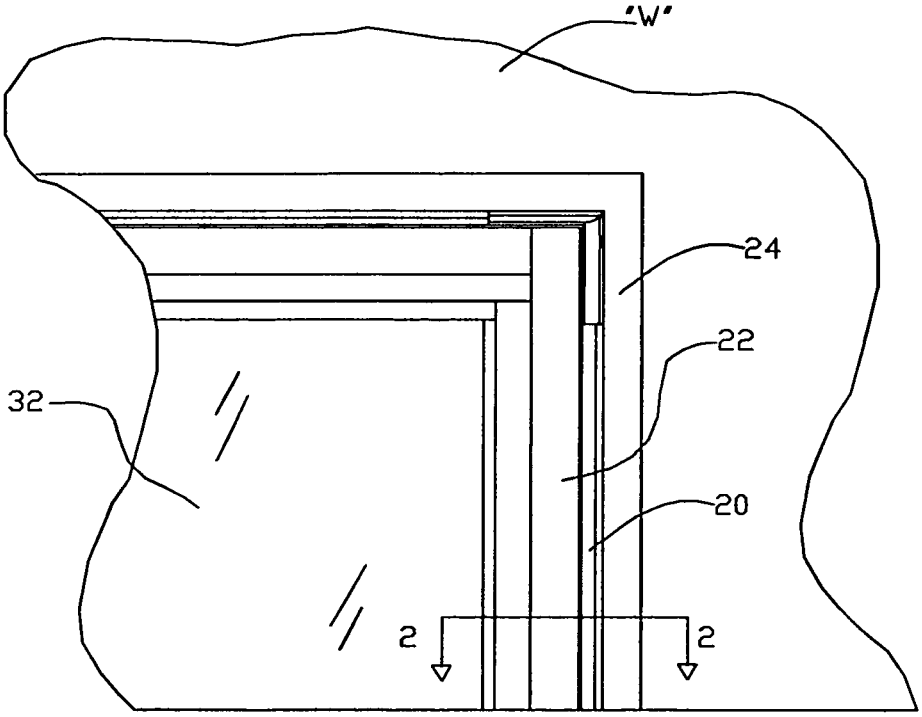
FIG. 1N is a elevational view of the interior front corner of a window assembled within an open of a wall in a building.

Referring now to the drawings in detail and particularly to FIG. 1, there is shown the present invention, in which a sealing assembly 20, for sizing and adapting a window frame or a door frame 22 into a building opening 24 with proper insulation and gap sealing arrangements therearound, so as to enable that window frame or door frame 22 to fit snugly within that building opening 24 and eliminate environmental penetration either from the outside-in or from the inside-out.

Figure 2N:
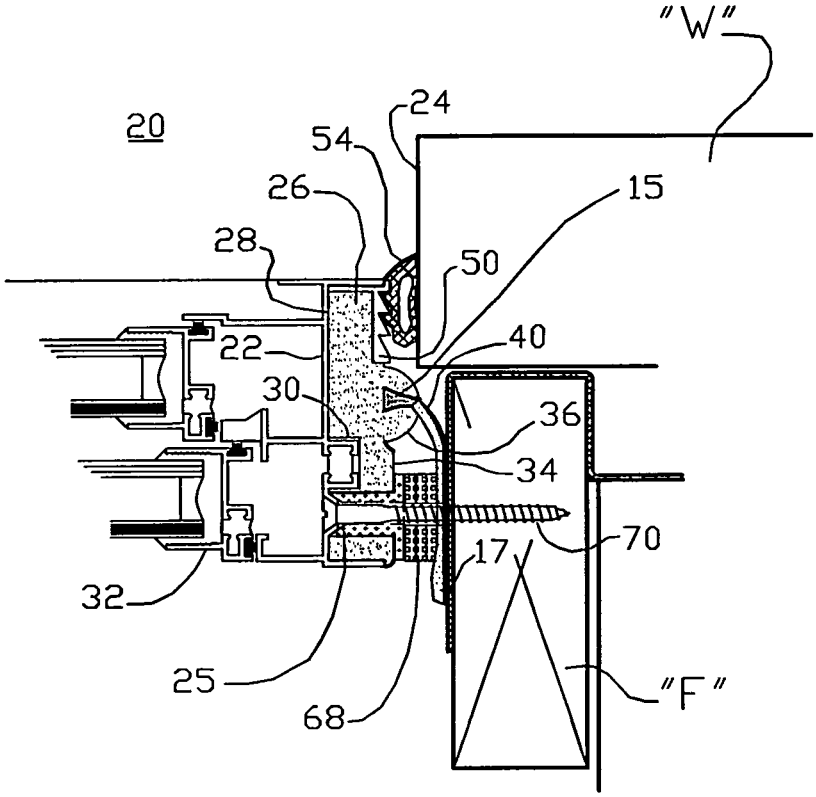
FIG. 2N is a cross-sectional view taken along the lines 2-2 of FIG. 1, showing of a first embodiment of the elongated foam member and caulking band arranged about a frame in a window opening.
Figure 3N:
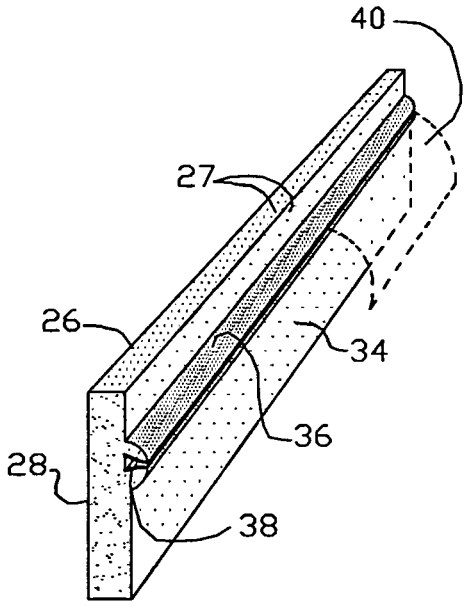
FIG. 3N is a perspective view of the elongated foam extrusion body in a first embodiment thereof.

The sealing assembly 20 comprises an extruded, elongated, generally rectilinearly shaped foam body insulating member 26, shown in assembled position in FIG. 2N and in perspective in FIG. 3N. The foam body insulating member 26 is preferably comprised of a closed cell foam of varying densities, and is shaped to provide desired surface contours for mating with supplemental components. The foam body insulating member 26 has a first or inwardly directed enclosure-frame facing side 28 which faces and mates snugly with a channel 30 of a wall-opening facing side of the window/door frame 22, the frame 22 being that which peripherally surrounds and supports a window sash or door 32 therewithin, as represented in FIGS. 1N and 2N. The foam body insulating member 26 also has a wall opening facing side 34 with extrusion-effected seal-engaging shapes as may be seen in FIG. 3N, as well as an elongated, angled "caulking band" attachment strip 27 for secure placement of a "caulking band" thereto, several embodiments of which caulking band are described hereinbelow. FIG. 3N represents a first embodiment foam body insulating member with an air fin 40, represented in phantom line, for clarity of viewing.

The seal engaging shape in a first embodiment of the foam body insulating member 26 of the present invention comprises a generally elongated (semicircular in cross-section) engaging ridge 36 which is extruded with the length of the foam body insulating member 26, as is best represented in FIG. 3N.

The engaging ridge 36 has an elongated truncated receiving channel 38 extending longitudinally therealong, as may be seen in FIG. 3N. The truncated receiving channel 38 preferably may have extruded barb-like teeth extending therewithin, not shown for clarity of viewing. The sealing assembly 20 further includes an elongated flexible air fin 40, as may be seen in FIGS. 1N, 4N, 5N, 6N and 7N.

Figure 4N:
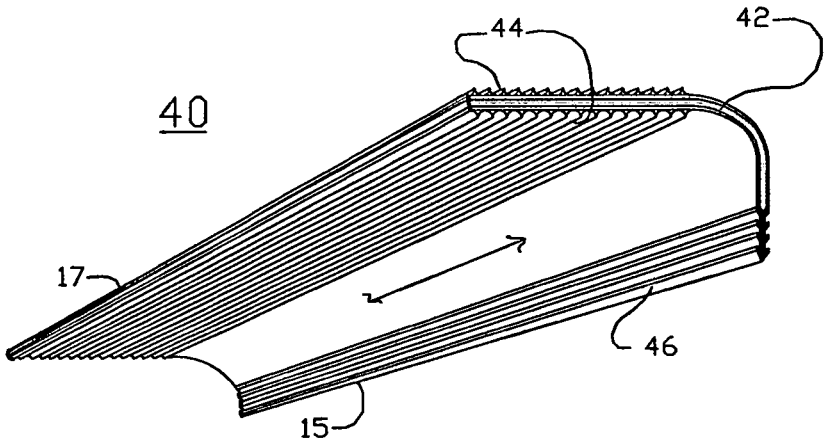
FIG. 4N is a perspective view of an air fin showing the ridges thereon, and its multilayer construction.

The air fin 40 itself, may be formed of a flexible metal, a polymer, rubber or the like. One preferably embodiment of the air fin 40 has an inner layer of soft insulated foam core material 42 extending through its entire length, as represented in FIG. 4N. The air fin 40 has longitudinal serrated edges 44 on both sides of a first elongated edge thereof, which first edge preferably have a saw tooth configuration of thereon, as shown in FIG. 4N, and a plurality of elongated arrowhead-like ridges 46 extrusively formed on the other or second edge as also shown in FIG. 4N, so that the second edge with ridges 46 thereon may be easily insertable and receivable snugly by the receiving channel 38 on the receiving ridge 36 of the elongated foam body member 26 (or in a further caulking band receiving channel 62 discussed hereinbelow). The elongated foam body member 26 is matively held within the peripheral receiving frame 22 which surrounds the door or window, as shown in FIGS. 2N and 5N.

Figure 2A:
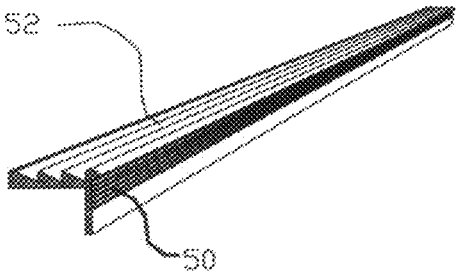
FIG. 2AN is a perspective view of the caulking band in a first embodiment thereof.

The sealing assembly 20 further includes a "caulk band" engagement flange 50 which is secured to an outer edge of the elongated foam body member 26, in a first embodiment thereof, represented in FIGS. 1N and 2AN. The engagement flange 50, preferably made of ABS plastic, vinyl or thermoplastic material, in a first embodiment thereof has a saw tooth building wall gasket-engaging edge 52 for engaging and compressing an elongated gasket member 54 against the side wall of the window opening 24, as represented in FIG. 1N.

Figure 5N:
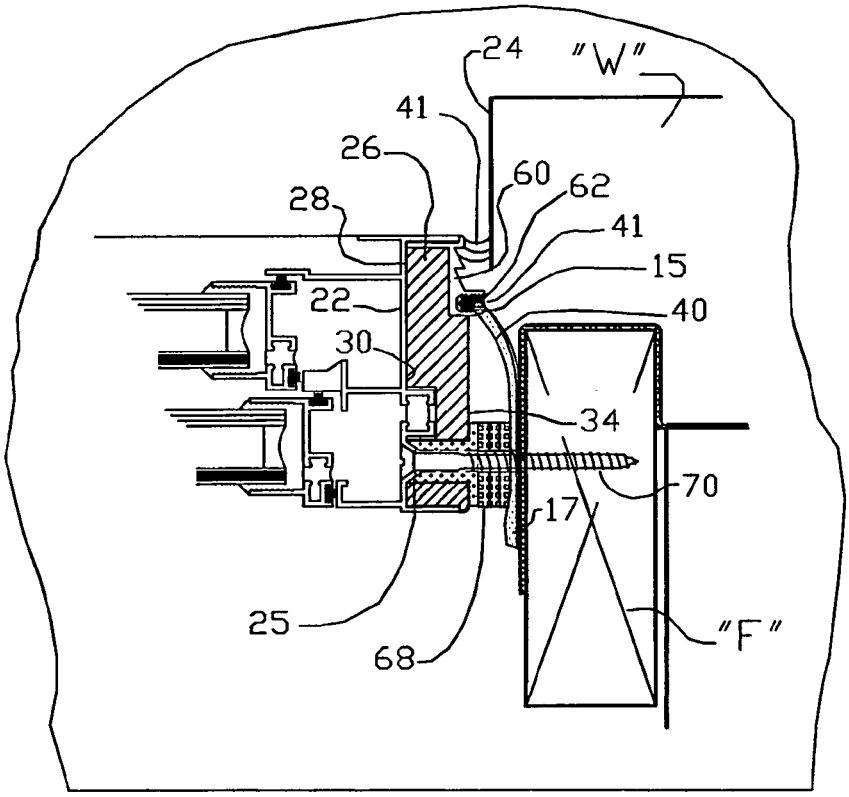
FIG. 5N is a cross sectional view taken along the lines 2-2 of FIG. 1, showing a second embodiment of the elongated foam member and caulking band arranged about a frame in a window opening.
Figure 6N:
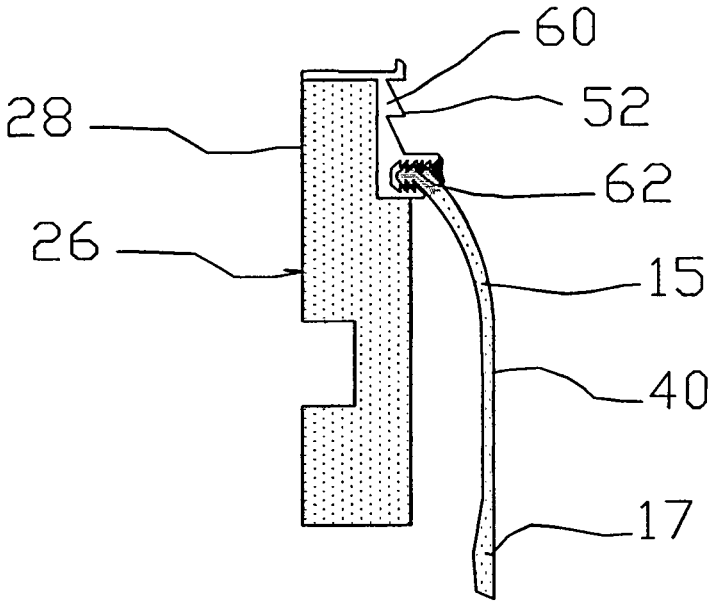
FIG. 6N is an enlarged end view of the foam member, the caulking band and an air fin therewith, represented in FIG. 5N.
Figure 7N:
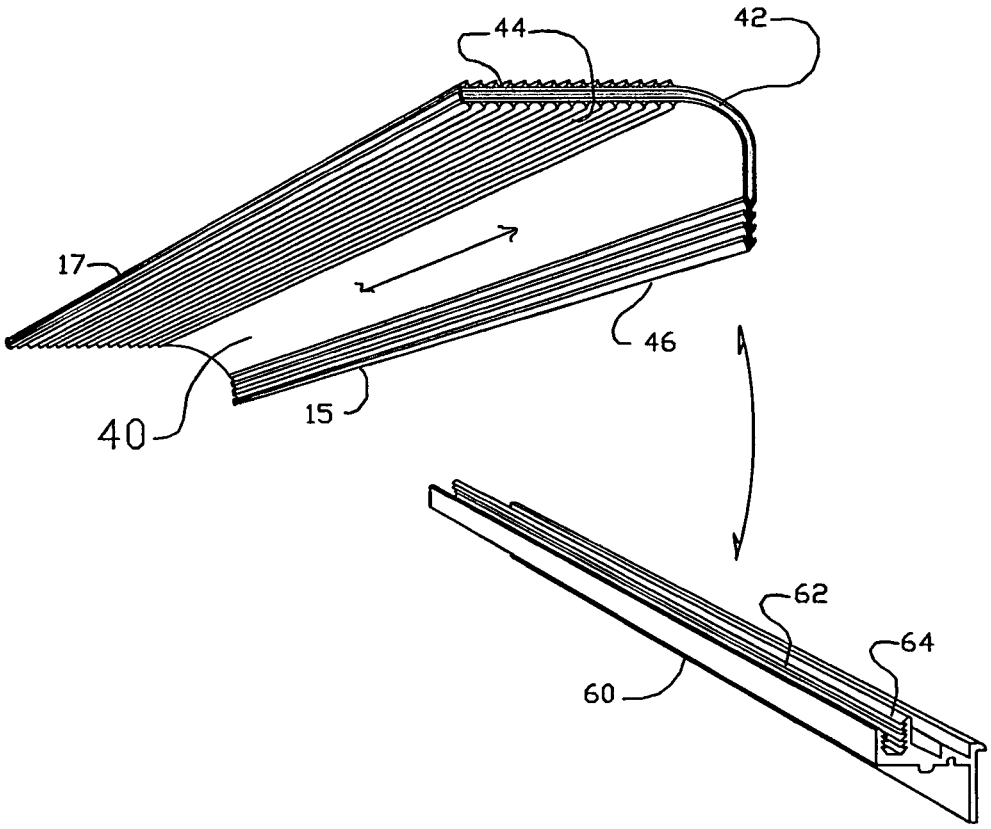
FIG. 7N is a perspective view of the first embodiment of the caulking band and an air fin thereadjacent.

A second embodiment of the "caulk band" is shown as an engagement flange 60, in FIGS. 5N, 6N and 7N. This engagement flange caulk band 60 has a receiving channel 62 therein, machined, formed or co-extruded therewith, having internal ridges 64 extending therealong, as may be best seen in FIGS. 5N, 6N and 7N. Those internal ridges 64 are utilized to fully grasp one longitudinal side of the elongated air fin 40 with the arrowhead ridges 46 thereon, when the air fin 40 is inserted therewithin, as represented 5N, 6N and 7N. An injectable sealant material 41 is preferably disposed around the periphery of the engagement flange 60, as represented in FIG. 5N, to provide a first outside barrier 40 to the multiple inside environmental barriers, that is, the air fin 40 and the elongated fender 68.

The sealing assembly 20 in one preferred embodiment is established when the receiving frame 22, which holds the window or door 32 therewithin, is secured to the frame "F" of the opening 24 in the building wall "W". The elongated foam body extrusion 26 is inserted into the channel of the receiving frame 22 so it faces the wall opening 24. A first elongated edge 15 of the air fin 40 is inserted into the air fin receiving channel 38 of the ridge 36 of the elongated foam body 26, as shown in FIG. 2N. A elongated spacer-fender 68 of resilient cushion material is inserted between the elongated foam extrusion 26 and the wall opening 24, as shown in FIGS. 2N and 5N, respectively. A elongated edge 17 of the air fin 40 is positioned between the elongated spacer-fender 68 so as to be captured between the elongated fender 68 and the frame "F" of the opening 24 in the wall "W" of the building, as represented in FIG. 5N. Securement fasteners 70 are inserted through cylindrically shaped shim posts 25 at the system designer's proper openings within the receiving frame 22, through the foam extrusion 26 and through the elongated spacer-fender 68 as well as the air fin 40 which is thus sealingly sandwiched against the frame "F" of the building opening 24 as represented in FIGS. 2N and 5N, so as to secure the entire assembly, including the window or door frame, to the internal periphery of the opening 24 within the wall of the building. The shim posts 25 are received or "housed" within the foam cell body member 26 at proper specific locations and prevent distortion of the frame 22 when the securement fasteners 70 are properly torqued (~110 ft/lb). Those shim posts 25 thus enable structural integrity and alignment without distorting or weakening the system 20.

Figure 8N:
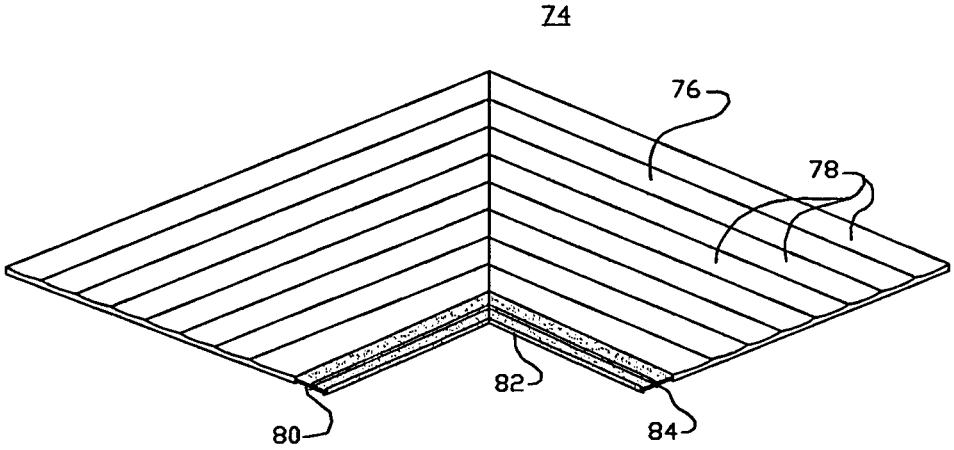
FIG. 8N is a perspective view air fin corner member.
Figure 8A:
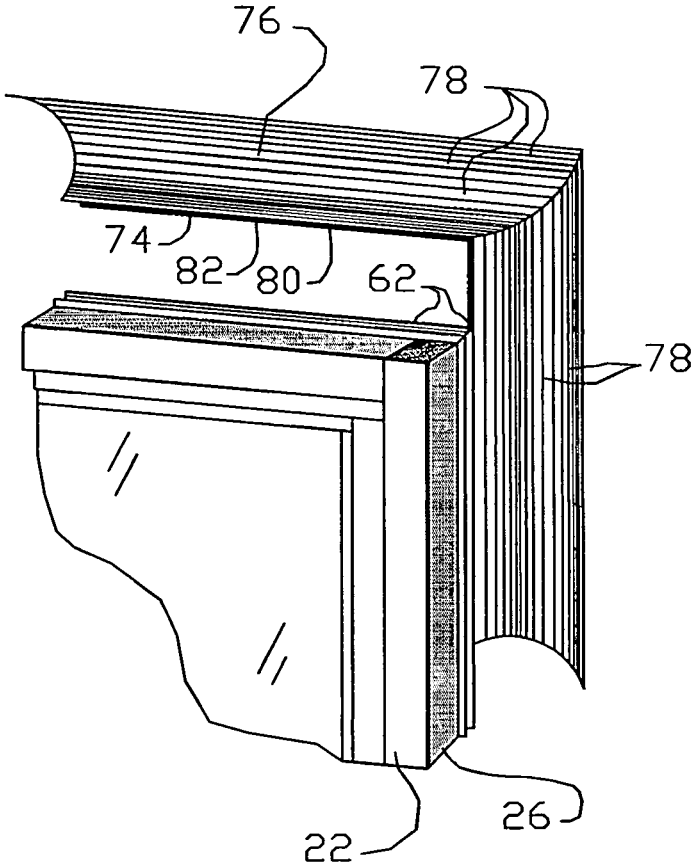
FIG. 8AN is a perspective view of an air fin corner member being mated with the second embodiment caulking member represented in FIGS. 5N, 6N, and 7N.
Figure 9N:
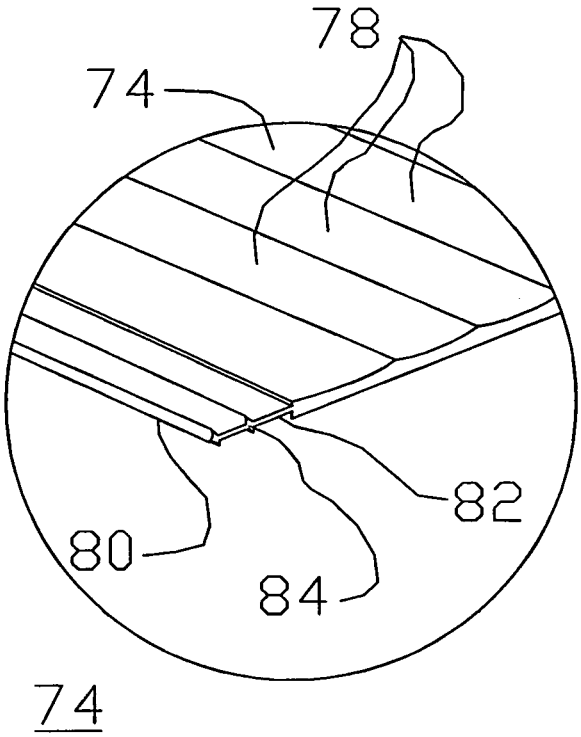
FIG. 9N is an enlarged view of an inside lip of the air fin corner member shown in FIG. 8N.

The sealing assembly 20 also includes a unitary "L" shaped air fin corner member 74, of flexible material as shown in FIG. 8N, having a first surface 76 with undulating sealant-caulk retaining ridges 78 thereon, and having an inner edge 80 with a receiving channel engaging lip 82 extending therefrom, as best seen in FIG. 8N. The lip 82 may lie in the plane of the pre-installed corner member 74, or may be angled with respect thereto. The lip 82 has a plurality of elongated flexible receiving channel engaging flaps 84 thereon to ensure proper engagement and sealing properties with the receiving channel 62 of an adjacent caulking band 60 as may be envisioned in FIGS. 6N and 7N, with which it mates. FIG. 8AN represents the corner member air fin 74 being inserted into the receiving channel 62 of the second embodiment caulking band 60, which corner member air fin 74 preferably overlaps a linear air fin 40 in their contiguous positioning in their respective receiving channels 62 of the second embodiment caulking band 60.

Thus what has been shown is a unique sealing and retention assembly for the safe, insulative retention of a door or window frame within an opening in a wall of a building being built or refurbished. Such sealing and retention assembly includes components such as the air fin, both linear and corner, which integrity of the sealing and retention assembly is maintained even during a seismic event, because of the inherent flexibility and sealing capacity of the components.

I claim:

1. A sealing assembly for securely and insulatively maintaining a window or door and surrounding frame arrangement within an opening of a building wall, the sealing assembly comprising:

an elongated foam cell body member arranged within a channel of the surrounding frame arrangement of the window or door, wherein the elongated foam cell body member has a wall-opening-facing side;

an elongated caulking band flange member in abutting relationship with a corner of the elongated foam cell body member peripherally nestled within the frame arrangement surrounding the window or door;

a thin flexible elongated air fin arranged in close environmental sealing relationship between the elongated foam cell body member and the opening in the wall of the building, wherein the thin flexible elongated air fin member has an inner layer of insulative foam material therein; and a securement member for fastening the window or door surrounding frame arrangement, the elongated foam cell body member and the air fin, all to the building wall opening.

2. The sealing assembly as recited in claim 1, wherein the elongated caulking band has an elongated receiving channel extending longitudinally therealong, in close proximity to the elongated foam cell body member.

3. The sealing assembly as recited in claim 2, wherein the elongated air fin has an elongated first edge which is snugly received in the elongated channel in the elongated caulking band.

4. The sealing assembly as recited in claim 3, wherein the elongated air fin has an elongated second edge which is fastened to the building wall opening by the securement member.

5. The sealing assembly as recited in claim 1, wherein an "L" shaped air fin is arranged in an end portion of peripherally adjacent elongated receiving channels of adjacent caulking bands surrounding the frame of the door or surrounding window.

6. A method of sealing and securely and insulatively maintaining a window or door and surrounding frame arrangement within an opening of a building wall, the sealing assembly comprising:

placing an elongated foam cell body member arranged within a channel of the surrounding frame arrangement of the window or door, wherein the elongated cell body member has a wall-opening-facing side;

securing an elongated caulking band flange member in abutting relationship with a corner of the elongated foam cell body member;

mating a thin flexible air fin arranged in close environmental sealing relationship with a receiving channel adjacent the elongated foam cell body member and the opening in the wall of the building;

a securement member for fastening the window or door surrounding frame arrangement, the elongated foam cell body member and the air fin, all to the building wall opening; and inserting an "L" shaped air fin into receiving channels of an "L" shaped corner configuration of adjacent caulking band members installed around the frame assembly.

7. The method as recited in claim 6, including:

attaching a caulk band onto a receiving strip of a foam cell body member, so as to permit a first edge air fin to be secured only to the caulk band.

* * * * *